US010544975B2

(12) United States Patent
Je

(10) Patent No.: US 10,544,975 B2
(45) Date of Patent: Jan. 28, 2020

(54) SPLASH SCREEN APPARATUS FOR ICE MAKER

(71) Applicant: DAEYEONG E&B Co., Ltd., Ansan-si, Gyeonggi-do (KR)

(72) Inventor: Sang Bong Je, Seoul (KR)

(73) Assignee: DAEYONG E&B Co., Ltd., Ansan-si (KR)

( * ) Notice: Subject to any disclaimer, the term of this patent is extended or adjusted under 35 U.S.C. 154(b) by 0 days.

(21) Appl. No.: 15/897,210

(22) Filed: Feb. 15, 2018

(65) Prior Publication Data

US 2019/0086135 A1 Mar. 21, 2019

(30) Foreign Application Priority Data

Sep. 18, 2017 (KR) ..... 10-2017-0119409

(51) Int. Cl.
*F25C 5/182* (2018.01)
*F25C 1/04* (2018.01)

(52) U.S. Cl.
CPC ..... *F25C 5/182* (2013.01); *F25C 1/04* (2013.01); *F25C 2400/04* (2013.01)

(58) Field of Classification Search
CPC ..... F25C 2400/04; F25C 1/04; F25C 5/182; F25C 5/20; F25C 5/24; F25C 1/12
See application file for complete search history.

(56) References Cited

U.S. PATENT DOCUMENTS

| | | | |
|---|---|---|---|
| 9,341,402 | B1 | 5/2016 | Loudermilk et al. |
| 2007/0119202 | A1 | 5/2007 | Kadowaki et al. |
| 2010/0139305 | A1 | 6/2010 | Ota et al. |
| 2014/0165598 | A1 | 6/2014 | Boarman et al. |
| 2014/0165618 | A1 | 6/2014 | Culley et al. |
| 2014/0165619 | A1 | 6/2014 | Culley |
| 2018/0017304 | A1* | 1/2018 | Knatt ..... F25C 1/25 |

FOREIGN PATENT DOCUMENTS

| | | |
|---|---|---|
| JP | H05240540 | 9/1993 |
| JP | 2523185 | 10/1996 |
| JP | 2005188828 | 7/2005 |
| JP | 2010025496 | 2/2010 |
| KR | 101335953 | 12/2013 |
| KR | 20140008008 | 1/2014 |

* cited by examiner

*Primary Examiner* — Elizabeth J Martin
(74) *Attorney, Agent, or Firm* — Burris Law, PLLC

(57) ABSTRACT

A splash screen apparatus for an ice maker includes an ice making portion for making ice, a water/ice separating portion separating water and ice dropped from the ice making portion, and an ice storage unit connected with the water/ice separating portion through a chute. The ice storage unit stores ice separated by the water/ice separating portion. The apparatus further includes a screen disposed above the chute and ice separated by the water/ice separating portion is passed into the ice storage unit and water is stopped from being introduced into the ice storage unit.

11 Claims, 6 Drawing Sheets

SPLASH SCREEN APPARATUS FOR ICE MAKER

CROSS-REFERENCE TO RELATED APPLICATIONS

This application claims priority to and the benefit of Korean Patent Application No. 10-2017-0119409 filed on Sep. 18, 2017. The disclosure of the above application is incorporated herein by reference.

FIELD

The present disclosure relates generally to an apparatus for an ice maker, and more particularly, to an apparatus that separates water from ice when ice is being transferred into an ice storage unit.

BACKGROUND

The statements in this section merely provide background information related to the present disclosure and may not constitute prior art.

Generally, an ice maker has a structure manufacturing ice by cooling water supplied from a water storage unit using an evaporator, separating ice manufactured from an ice making portion, and then dropping ice.

FIG. 1 is a front view of a conventional ice maker and FIG. 2 is a detailed view showing an ice making portion and a water/ice separating portion of a conventional ice maker.

In detail, referring to FIGS. 1 and 2, a water storage 2 is disposed below the ice making portion 1, an ice storage 3 is disposed at a side surface of the water storage 2, and a mechanical unit 4 is disposed at a side surface of the ice making portion 1.

Here, separated ice and water flowing on a surface of an evaporator 6 are dropped together from the ice making portion 1, so the water/ice separating portion 7 is disposed below the ice making portion 1 so as to drop water into the water storage 2 and to move ice into the ice storage 3.

That is, water dropped from the ice making portion 1 flows into the water storage 2 again and is resupplied into the ice making portion 1 for manufacturing ice. In the meanwhile, ice dropped from the ice making portion 1 moves into the ice storage 3 through the chute 5.

However, water dropped from the ice making portion 1 collides with the water/ice separating portion 7 and splashes to the ice storage 3 such that water splashes to outside.

Thus, ice output per amount of supplied ice-making water, which is an index to evaluate performance of an ice maker, is reduced such that efficiency of the ice maker decreases, and ice in the ice storage is melted by introduced water.

The foregoing is intended merely to aid in the understanding of the background of the present disclosure, and is not intended to mean that the present disclosure falls within the purview of the related art that is already known to those skilled in the art.

SUMMARY

The present disclosure provides an ice maker that is configured to stop splashed water from being introduced into an ice storage unit during a separation process of ice and water which are dropped from an ice making portion.

According to one aspect of the present disclosure, there is provided a splash screen apparatus for an ice maker, the apparatus including: an ice making portion making ice; a water/ice separating portion separating water and ice dropped from the ice making portion; an ice storage unit connected with the water/ice separating portion through a chute and storing ice separated by the water/ice separating portion; and a screen disposed above the chute and passing ice separated by the water/ice separating portion into the ice storage unit, but stopping water from being introduced into the ice storage unit.

The splash screen apparatus for the ice maker may further include: a water storage unit disposed below the water/ice separating portion for storing water separated by the water/ice separating portion.

The water/ice separating portion may include slits defined therein and a size of the slits may be configured to be smaller than a size of ice manufactured from the ice making portion, so water dropped from the ice making portion is dropped downward through the slits and is stored in the water storage unit, and ice is separated from water since the size of ice is bigger than the size of the slits and inhibits ice from passing therethrough.

The ice storage unit may be disposed at a side of the water storage unit and an upper surface of the water/ice separating portion may be configured to tilt downward in a direction toward the ice storage unit, thereby delivering ice separated by the water/ice separating portion to the ice storage unit through the chute.

A side surface of the ice making portion may be surrounded by an insulating layer and an upper portion of the screen may be rotatably connected to a lower portion of the insulating layer.

A lower portion of the screen may be pushed by weight of ice separated by the water/ice separating portion, so the chute may be closed or opened by rotation of the upper portion of the screen.

The lower portion of the insulating layer may include a protruding pin protruding toward the ice making portion and the protruding pin of the insulating layer may penetrate a through hole formed on the upper portion of the screen, thereby connecting the insulating layer and the screen to each other.

The protruding pin may slantingly extend upward at an end thereof facing the ice making portion, and during a rotation of the screen about the protruding pin in a direction toward the ice storage unit, the rotation of the screen may be stopped by an end of the protruding pin at a predetermined degree angle.

The lower portion of the insulating layer may include a support shoulder protrudingly formed, the protruding pin may protrude from the support shoulder toward the ice making portion, and the screen may be supported by the support shoulder while being fitted to the protruding pin, so the screen may be spaced apart from the insulating layer and the rotation thereof toward the ice making portion may be stopped.

The splash screen apparatus for the ice maker may further include: a gap being defined below the chute and dropping water introduced from the water/ice separating portion into the ice storage unit, wherein the water dropped from the gap moves into a water storage unit.

The gap may be configured to pass water and not pass ice.

A lower portion of the screen may be disposed above the gap while not rotating.

A lower portion of the screen may become narrow toward an end thereof.

The lower portion of the screen may be configured in a sawtooth shape.

The splash screen apparatus for the ice maker according to an exemplary form of the present disclosure is capable of manufacturing more ice with a same amount of water, thereby increasing ice manufacturing efficiency.

In addition, the apparatus according to an exemplary form of the present disclosure is capable of inhibiting water from being introduced into the ice storage unit so as to inhibit stored ice from being melted by water, thereby improving quality of ice.

The above-described properties, features and advantages of the present disclosure, as well as the manner in which they are achieved, will become clearer and more easily understood in the following schematic description of one form, and they are explained below in greater detail with reference to the drawings. It should be understood that the description and specific examples are intended for purposes of illustration only and are not intended to limit the scope of the present disclosure.

BRIEF DESCRIPTION OF THE DRAWINGS

In order that the disclosure may be well understood, there will now be described various forms thereof, given by way of example, reference being made to the accompanying drawings, in which.

Figure 1:
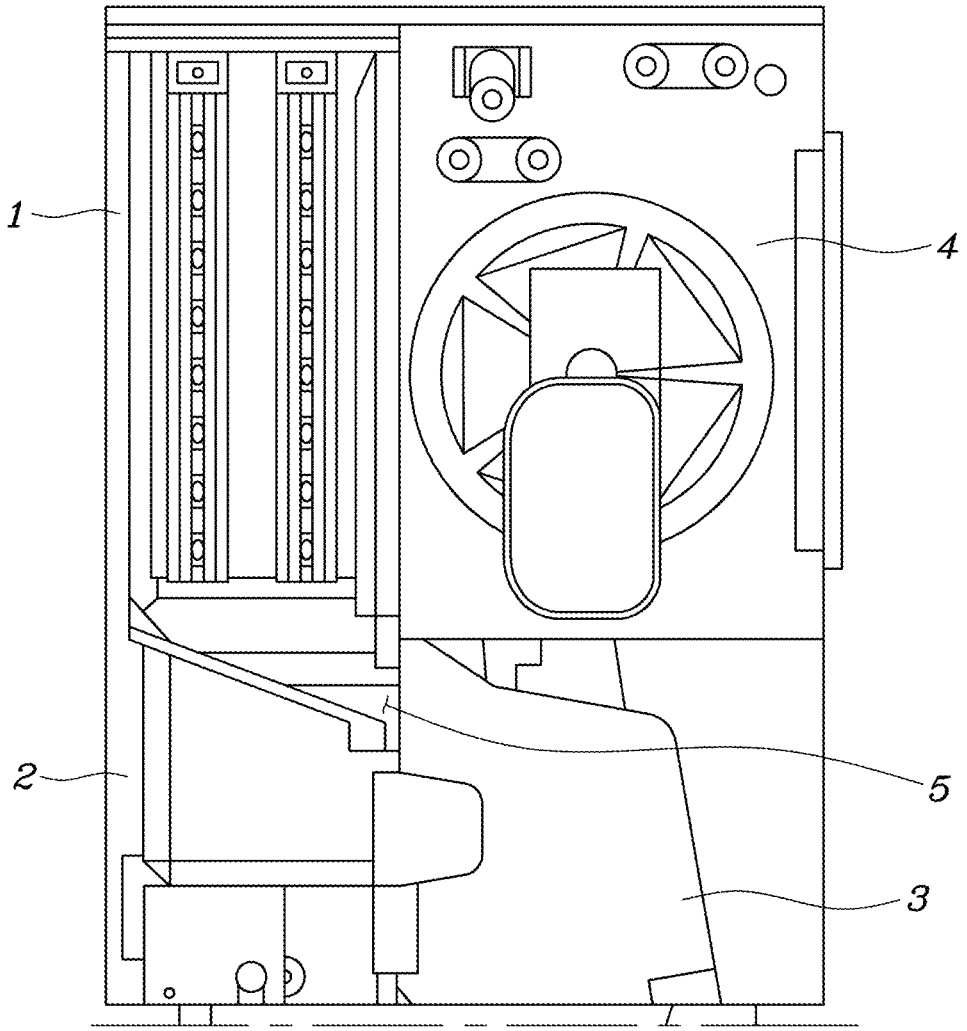
FIG. 1 PRIOR ART
FIG. 1 is a front view of a conventional ice maker according to the prior art.
Figure 2:
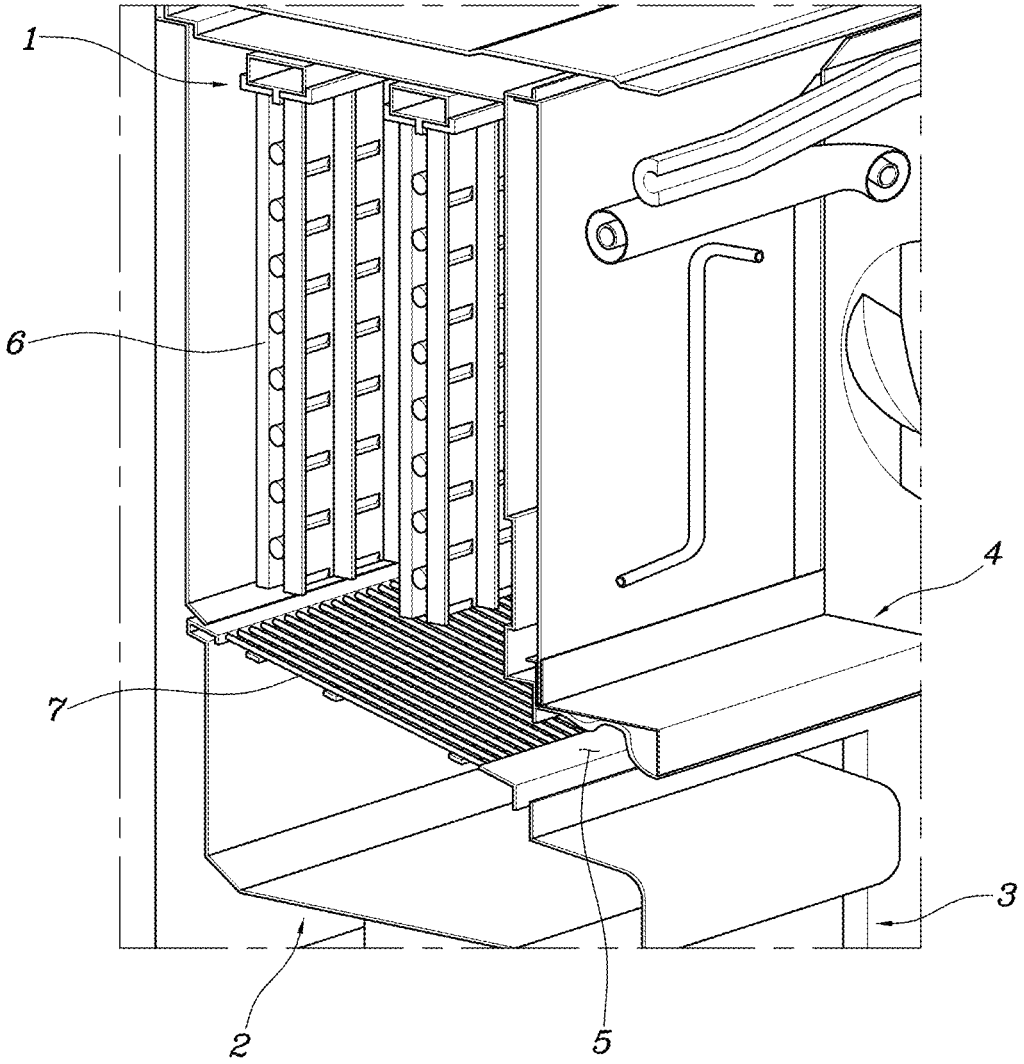
FIG. 2 PRIOR ART
FIG. 2 is a detailed view showing an ice making portion and a water/ice separating portion of a conventional ice maker according to the prior art.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Specific structural and functional descriptions of various forms of the present disclosure disclosed herein are only for illustrative purposes only. The present disclosure may be employed in many different forms without departing from the spirit and significant characteristics of the present disclosure. Therefore, the various forms of the present disclosure should not be construed as limiting the present disclosure.

Reference will now be made in detail to various forms of the present disclosure, specific examples of which are illustrated in the accompanying drawings and described below, since the forms of the present disclosure can be variously modified in many different forms. While the present disclosure will be described in conjunction with exemplary forms thereof, it is to be understood that the present description is not intended to limit the present disclosure to those exemplary forms. On the contrary, the present disclosure is intended to cover not only the exemplary forms, but also various alternatives, modifications, equivalents and other forms that may be included within the spirit and scope of the present disclosure as defined by the appended claims.

It will be understood that, although the terms "first", "second", etc. may be used herein to describe various elements, these elements should not be limited by these terms. These terms are only used to distinguish one element from another element. For instance, a first element discussed below could be termed a second element without departing from the teachings of the present disclosure. Similarly, the second element could also be termed the first element.

It will be understood that when an element is referred to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present. Other expressions that explain the relationship between elements, such as "between", "directly between", "adjacent to", or "directly adjacent to" should be construed in the same way.

The terminology used herein is for the purpose of describing particular forms only and is not intended to be limiting. As used herein, the singular forms "a", "an", and "the" are intended to include the plural forms as well, unless the context clearly indicates otherwise. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Unless otherwise defined, all terms including technical and scientific terms used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Herein below, exemplary forms of the present disclosure will be described in detail with reference to the accompanying drawings. Throughout the drawings, the same reference numerals will refer to the same or like parts.

An ice maker of the present disclosure may include an undercounter type which includes an ice storage unit 30 therein and another type having a separate outside bin, wherein the bin may be an ice storage unit 30.

Figure 3:
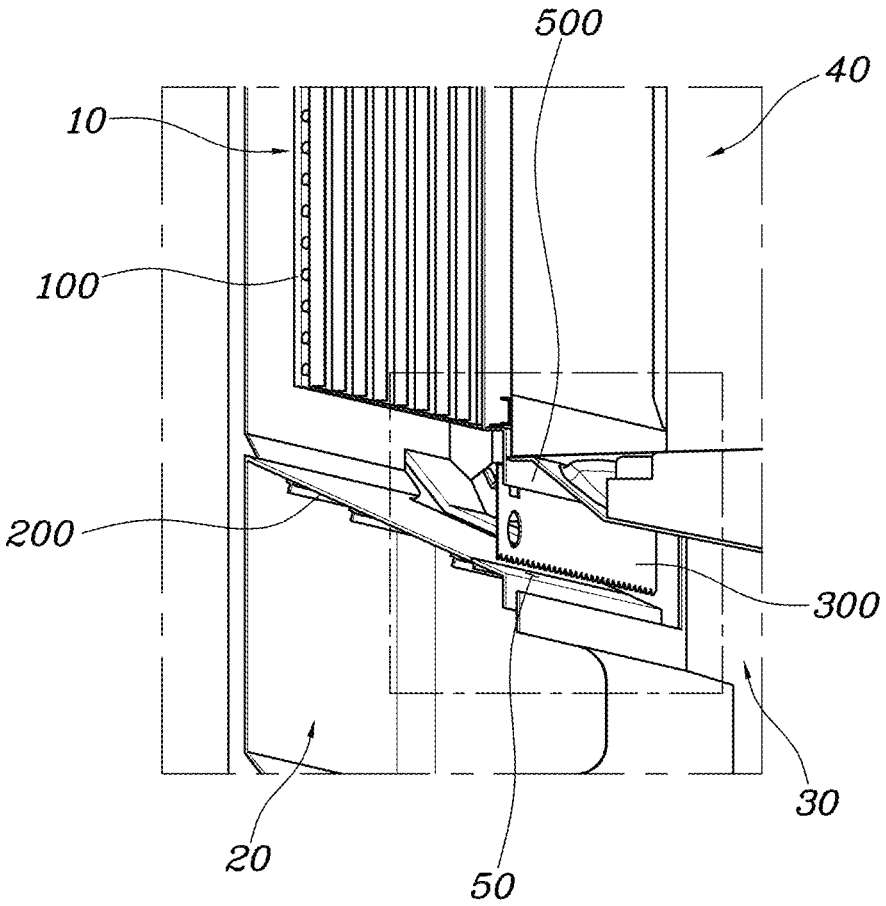
FIG. 3 is a detailed view of an ice maker according to an exemplary form of the present disclosure.

FIG. 3 is a detailed view of an ice maker according to an exemplary form of the present disclosure.

Figure 4:
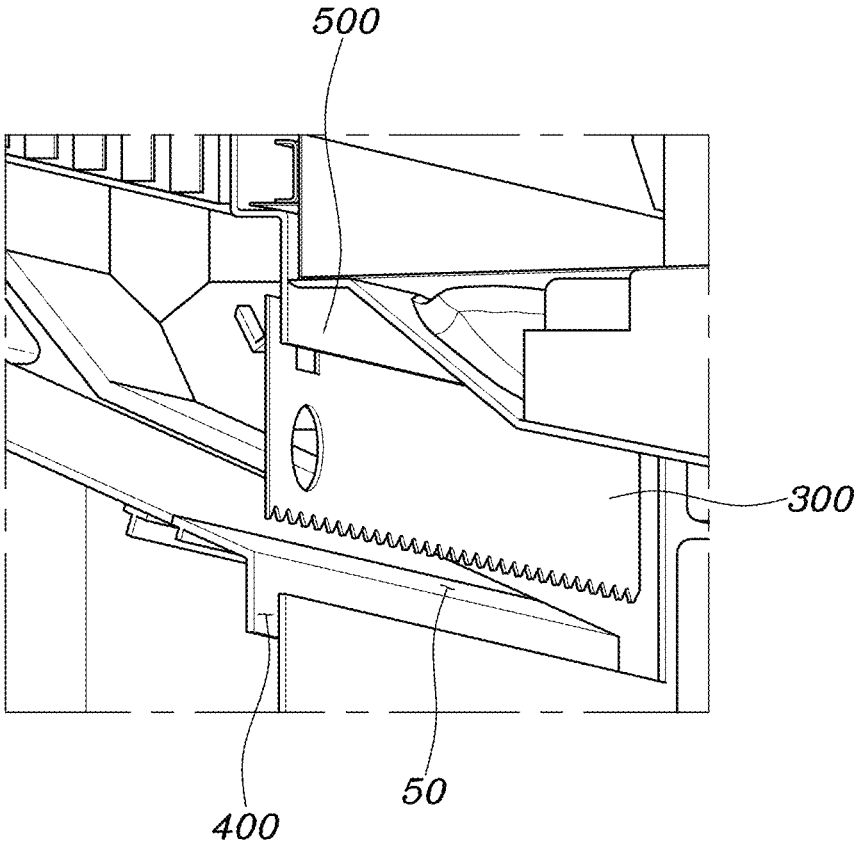
FIG. 4 is a detailed view of a portion of the ice maker of FIG. 3.

Referring to FIGS. 3 and 4, a splash screen apparatus for the ice maker according to this form of the present disclosure includes: an ice making portion 10 making ice; a water/ice separating portion 200 separating water and ice dropped from the ice making portion 10; an ice storage unit 30 connected with the water/ice separating portion 200 through a chute 50 and storing ice separated by the water/ice separating portion 200; and a screen 300 disposed above the chute 50 and passing ice separated by the water/ice separating portion 200 into the ice storage unit 30, but stopping water from being introduced into the ice storage unit 30.

The splash screen apparatus for the ice maker may further includes: a water storage unit 20 disposed below the water/ice separating portion 200 and storing water separated at the water/ice separating portion 200. The water storage unit 20 may store water separated by the water/ice separating portion 200 and water supplied from outside, and may supply water to the ice making portion 10. The ice making portion 10 may manufacture ice by pumping up water from the water storage unit 20 using a pump and letting water flow on an ice making plate 100 near an evaporator.

A mechanical unit 40 may be disposed at a side surface of the ice making portion 10. The mechanical unit 40 may include various devices such as a compressor (not shown) compressing refrigerant and a heat dissipation plate (not shown) dissipating heat of the refrigerant, and may cool water flowing on the ice making plate 100 using the refrigerant supplied to the evaporator (not shown) disposed at the ice making plate 100 of the ice making portion 10.

Ice manufacturing and ice separating processes are repeated at the ice making portion 10 such that ice manufactured from the ice making portion 10 and water may be dropped down. The water/ice separating portion 200 may be disposed under the ice making portion 10. The ice making plate 100 of the ice making portion 10 may further include a heating wire (not shown), thereby ice is separated by the heating wire (not shown) after water is cooled by the evaporator (not shown) and ice is manufactured.

The water/ice separating portion 200 may include slits defined therein. A size of the slits may be configured to be smaller than a size of ice manufactured from the ice making portion 10, so water dropped from the ice making portion 10 is dropped downward through the slits and is stored in the water storage unit 20, and ice is separated from water since the size of ice is bigger than the size of the slits, thereby prohibiting ice from passing therethrough. That is, the water/ice separating portion 200 may be configured to be a mesh structure having slits smaller than the size of manufactured ice.

The screen 300 is disposed above the chute 50 and passes ice separated by the water/ice separating portion 200 into the ice storage unit 30, but stops water from being introduced into the ice storage unit 30.

Some of water dropped from the ice making portion 10 collides with the water/ice separating portion 200 and splashes, and when some of splashing water goes into the ice storage unit 30, a structure of the screen 300 stops the splashing water from being introducing into the ice storage unit.

Figure 5:
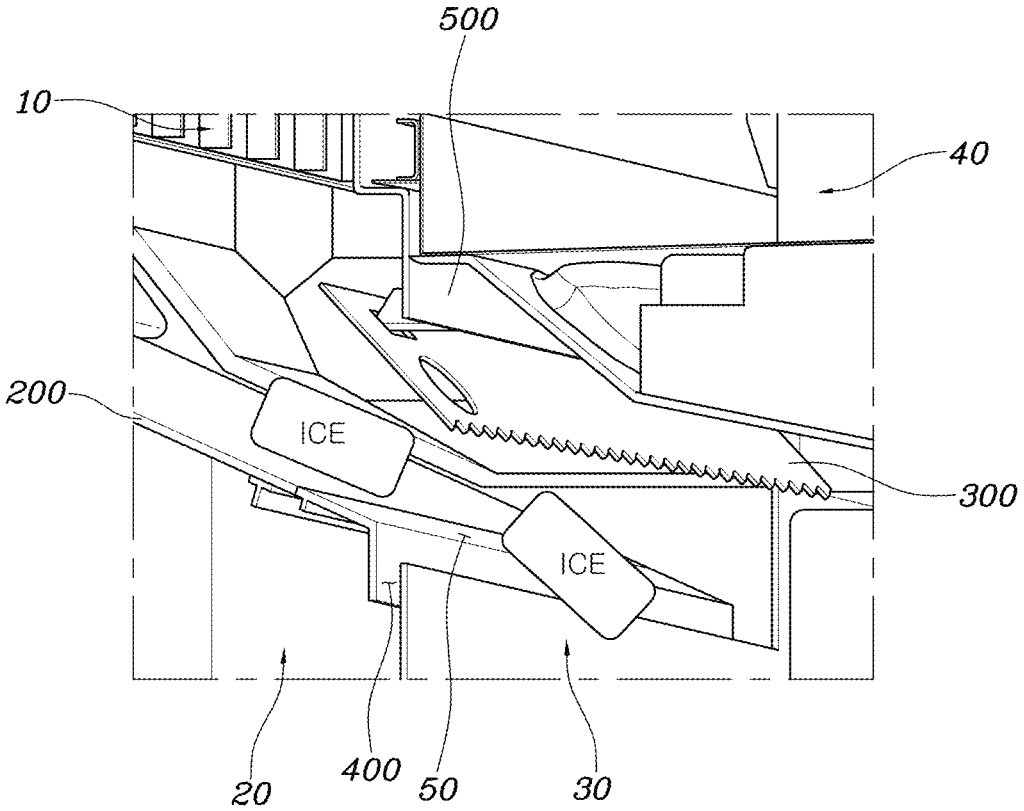
FIG. 5 shows transfer of ice separated by a water/ice separating portion.

FIG. 5 shows transfer of ice separated from the water/ice separating portion 200.

Referring to FIG. 5, the ice storage unit 30 may be disposed at a side of the water storage unit 20 and an upper surface of the water/ice separating portion 200 may be configured to tilt downward in a direction toward the ice storage unit 30. That is, the ice storage unit 30 is disposed at the side lower portion of the water/ice separating portion 200 and the upper surface of the water/ice separating portion 200 is tilted downward in a direction toward the ice storage unit 30, so ice separated by the water/ice separating portion 200 may be delivered to the ice storage unit 30 while sliding along the upper surface of the water/ice separating portion 200 due to the weight thereof and through the chute 50.

A side surface of the ice making portion 10 may be surrounded by an insulating layer 500 so as to block heat exchange with outside. Particularly, the insulating layer 500 may block heat generated from the mechanical unit 40 disposed at a side of the ice making portion 10. An upper portion of the screen 300 may be rotatably connected to a lower portion of the insulating layer 500.

The lower portion of the screen 300 is pushed by weight of ice separated out from the water/ice separating portion 200, so the chute 50 may be closed or opened by rotation of the upper portion of the screen 300 connected to the lower portion of the insulating layer 500 toward the ice storage unit 30.

The screen 300 is pushed by weight of ice separated by the water/ice separating portion 200 thereby passing ice. That is, the screen 300 blocks water splashed from the water/ice separating portion 200. However, when ice separated by the water/ice separating portion 200 moves into the ice storage unit 30, the screen 300 is pushed by weight of ice and rotates such that ice smoothly moves into the ice storage unit 30.

The upper portion of the screen 300 is rotatably connected to the insulating layer 500 and when the lower portion of the screen 300 is pushed by weight of ice, the upper portion of the screen 300 rotates whereby the lower portion is opened. In detail, ice separated by the water/ice separating portion 200 slides along the inclined surface thereof and when the lower portion of the screen 300 is pushed by weight of ice, the upper portion of the screen 300 rotates thereby opening the chute 50 such that ice moves to the ice storage unit 30.

The screen 300 may have appropriate weight not to rotate by splashed water so as to block the chute 50, and to rotate so as to open the chute 50 only when pushed by weight of ice.

Figure 6:
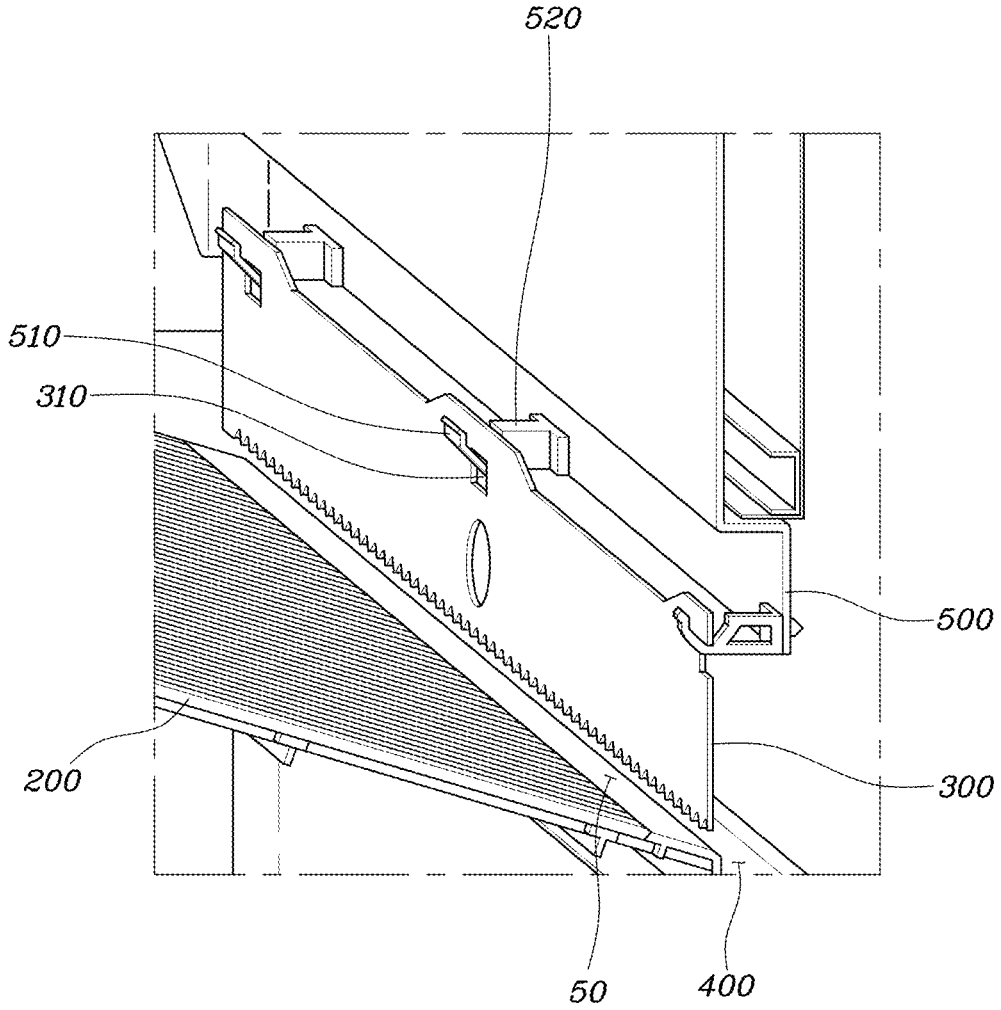
FIG. 6 shows a connection relationship of a screen with other members in detail according to an exemplary form of the present disclosure.

FIG. 6 shows a connection relationship of a screen 300 in detail according to the exemplary form of the present disclosure.

Referring to FIG. 6, the lower portion of the insulating layer 500 includes a protruding pin 510 protruding toward the ice making portion 10 and the protruding pin 510 of the insulating layer 500 penetrates a through hole 310 formed on the upper portion of the screen 300, thereby connecting the insulating layer 500 and the screen 300 to each other. That is, the through hole 310 formed on the upper portion of the screen 300 is configured to engage with the protruding pin 510 of the lower portion of the insulating layer 500, thereby enabling the screen to be rotatably connected.

The protruding pin 510 slantingly extends upward at an end thereof facing the ice making portion 10, during a rotation of the screen 300 about the protruding pin 510 in a direction toward the ice storage unit 30, the rotation of the screen 300 may be stopped by an end of the protruding pin 510 at a predetermined degree angle. In detail, the through hole 310 of the screen 300 is engaged with the protruding pin 510 slantingly extending up toward the end of the ice making portion 10, thereby when the screen 300 rotates to the ice storage unit 30 at the predetermined degree angle, the rotation of the screen 300 may be stopped by the end of the protruding pin 510.

The screen 300 is limited to rotate toward the ice storage unit 30 in a range of the predetermined degree angle thereby inhibiting crash between the lower portion of the screen 300 and the upper surface of the chute 50 such that vibration and noise are inhibited. Furthermore, the rotation degree angle of the screen 300 may be limited to slow the transfer of ice, thereby reducing transferring velocity of ice which moves to the ice storage unit 30.

The lower portion of the insulating layer 500 may include a support shoulder 520 protrudingly formed, the protruding pin 510 may protrude from the support shoulder 520 toward the ice making portion 10, and the screen 300 may be supported by the support shoulder 520 while being fitted to the protruding pin 510, so the screen 300 is spaced apart from the insulating layer 500 and the rotation thereof toward the ice making portion 10 is stopped.

That is, the support shoulder 520 is formed to protrude from the lower portion of the insulating layer 500 toward the ice making portion 10, and again, the protruding pin 510 is formed to protrude from the support shoulder 520 toward the ice making portion 10. The screen 300 is penetrated and press-fitted into the protruding pin 510 at a location spaced apart from the insulating layer 500 by the support shoulder 520. In addition, when the screen 300 rotates about the protruding pin 510, the rotation thereof toward the ice making portion 10 may be stopped at the predetermined degree angle by the support shoulder 520, or may be blocked to not rotate toward the ice making portion 10.

The apparatus may further include: a gap 400 defined below the chute 50 and dropping water introduced from the water/ice separating portion 200 into the ice storage unit 30, wherein the water dropped from the gap 400 may move into the water storage unit 20.

As shown in FIGS. 4-6, the gap 400 may be formed to cross a longitudinal direction of the chute 50 below the chute 50 so as to drop water from the water/ice separating portion 200 through the chute 50 into the ice storage unit 30.

The gap 400 may be configured to pass water and not pass ice.

The lower portion of the screen 300 may be disposed above the gap 400 while not rotating. The screen 300 blocks splashed water so as to drop water flowing along the screen 300 into the gap 400.

The screen 300 and the gap 400 inhibit water from splashing to outside such that ice output per amount of supplied ice-making water, which is one of important indexes to evaluate performance of an ice maker, may be increased.

The lower ends portion of the screen 300 may taper. In detail, the lower portion of the screen 300 may be configured in a sawtooth structure.

As shown in FIGS. 3-6, the lower portion of the screen 300 may be cut in the sawtooth structure, or in sharp shapes such as blades of a knife or an ice skate blade.

When the screen 300 rotates around the connected upper portion thereof by weight of ice and then the chute 50 connecting to the ice storage unit 30 opens, the lower portion of the screen 300 may be contact with an upper surface of ice while ice moves to the ice storage unit 30. At this point, as the lower ends portion of the screen 300 are formed to taper or be sawtooth structure, the structure thereof may inhibit ice from being stuck at the screen 300 such that ice moves smoothly.

Various forms of the present disclosure have been described for illustrative purposes, those skilled in the art will appreciate that various modifications, additions and substitutions are possible, without departing from the scope and spirit of the present disclosure as disclosed in the accompanying claims.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A splash screen apparatus for an ice maker, the splash screen apparatus comprising:

an ice maker;

a water/ice separator;

an ice storage connected with the water/ice separator;

a chute connected between the ice storage and water/ice separator; and a screen disposed above the chute to allow ice to pass and inhibit water from entering the ice storage, wherein a side surface of the ice maker is surrounded by an insulating layer and an upper portion of the screen is connected to a lower portion of the insulating layer to be tilt, wherein the lower portion of the insulating layer includes a protruding pin protruding toward the ice maker and the protruding pin of the insulating layer penetrates a through hole formed on the upper portion of the screen, thereby connecting the insulating layer to the screen.

2. The splash screen apparatus of claim 1 further comprising:

a water storage disposed below the water/ice separator.

3. The splash screen apparatus of claim 2, wherein the water/ice separator includes slits having a size smaller than a size of ice manufactured from the ice maker such that water dropped from the ice maker drops downward into the water storage through the slits and is stored in the water storage, and ice is separated from water since the size of ice is bigger than the size of the slits, and thus no ice passes through the slits.

4. The splash screen apparatus of claim 2, wherein the ice storage is disposed at a side of the water storage and an upper surface of the water/ice separator is configured to tilt downward in a direction toward the ice storage.

5. The splash screen apparatus of claim 1, wherein a lower portion of the screen is pushed by weight of ice separated by the water/ice separator such that the chute is blocked or opened by tilt of the upper portion of the screen.

6. The splash screen apparatus of claim 1, wherein when ice is not passing through a lower portion of the screen, the chute is in a blocked position.

7. The splash screen apparatus of claim 1, wherein an end of the protruding pin slantingly extends upward facing the ice maker, and when the screen tilts about the protruding pin in a direction toward the ice storage, the tilt of the screen is stopped by the end of the protruding pin at a predetermined degree angle.

8. The splash screen apparatus of claim 1, wherein the lower portion of the insulating layer includes a support shoulder protrudingly formed, the protruding pin protruding from the support shoulder toward the ice maker, and the screen being supported by the support shoulder while being fitted to the protruding pin such that the screen is spaced apart from the insulating layer and tilt toward the ice maker is stopped.

9. The splash screen apparatus of claim 1 further comprising a gap defined below the chute and configured to have a size of passing water and not passing a determined size ice and the gap configured to prevent dropping water from the water/ice separator from directing into the ice storage, wherein the water dropped from the gap is stored in a water storage.

10. The splash screen apparatus of claim 9, wherein a lower portion of the screen is disposed above the gap when the screen is not tilting.

11. The splash screen apparatus of claim 1, wherein the lower portion of the screen defines a sawtooth shape.

* * * * *